US006095843A

United States Patent [19]

Kaneko et al.

[11] Patent Number: 6,095,843

[45] Date of Patent: Aug. 1, 2000

[54] CONNECTOR FITTING CONSTRUCTION

[75] Inventors: Satoru Kaneko; Toru Nagano, both of Shizuoka, Japan

[73] Assignee: Yazaki Corporation, Tokyo, Japan

[21] Appl. No.: 09/149,091

[22] Filed: Sep. 8, 1998

[30] Foreign Application Priority Data

Sep. 9, 1997 [JP] Japan ..... 9-244491
Jul. 21, 1998 [JP] Japan ..... 10-205321

[51] Int. Cl.[7] ..... H01R 13/627

[52] U.S. Cl. ..... 439/352

[58] Field of Search ..... 439/350–352, 439/489, 490

[56] References Cited

U.S. PATENT DOCUMENTS

| | | | |
|---|---|---|---|
| 4,548,455 | 10/1985 | Ezure | 439/352 |
| 5,082,455 | 1/1992 | Wei | 439/352 |
| 5,674,086 | 10/1997 | Hashizawa et al. | 439/352 |
| 5,791,930 | 8/1998 | Takata et al. | 439/352 |

FOREIGN PATENT DOCUMENTS

| | | | |
|---|---|---|---|
| 5-81967 | 11/1993 | Japan | H01R 13/639 |

*Primary Examiner*—Hien Vu
*Attorney, Agent, or Firm*—Sughrue, Mion, Zinn, Macpeak & Seas, PLLC

[57] ABSTRACT

In a connector fitting construction, a male connector includes an exclusive-use housing having a slider receiving portion for slidably receiving a slider. A lock arm is provided at a widthwise-central portion of a lower portion of the slider receiving portion. A housing lock for retaining engagement with a female housing is formed on a lower surface of a front end of the lock arm. The slider is constituted by a first slide member and a second slide member, and the first slide member includes a pair of arms, an interconnecting portion interconnecting these arms, and abutment posts. An abutment portion is formed at a front end of each of the arms. The second slide member includes a retaining portion for retaining the housing lock at the front end of the lock arm, and an operating portion, which is operated when canceling the fitted condition, and a pair of retainer portions with which one ends of tension springs are engaged, respectively.

12 Claims, 14 Drawing Sheets

1
2
2a
3a
3b
6
8
10
11
15
16
21
22
23
24
30
31
32
33

CONNECTOR FITTING CONSTRUCTION

BACKGROUND OF THE INVENTION

1. Field of the Invention

This invention relates to a connector fitting construction in which a half-fitted condition is positively prevented by a resilient force of a resilient member mounted in a housing of at least one of a pair of female and male connectors to be fitted and connected together, and the connector, fitted on the mating connector, is positively locked.

2. Description of the Related Art

Usually, many electronic equipments for effecting various controls are mounted on a vehicle such as an automobile, and therefore, naturally, many wire harnesses and flat cables have been used. Automobiles and the like are used in a severe environment in which vibrations and submergence are encountered, and therefore there have been used various types of female and male connectors which have a waterproof function, and can be easily connected to and disconnected from a wire harness or the like in view of the efficiency of an assembling operation and the efficiency of the maintenance.

Various half-fitting prevention connectors, in which a condition of fitting between female and male connectors can be detected, have been used, and one such example is disclosed in Japanese Utility Model Unexamined Publication No. Hei. 5-81967.

One example of conventional half-fitting prevention connector will now be described with reference to FIG. 15.

As shown in FIG. 15, a conventional half-fitting prevention connector 80 comprises a pair of female and male connectors 81 and 82, and the female connector 81 has a plurality of male pin contacts 83 mounted therein, and the male connector 82 has a plurality of female socket contacts 84 mounted therein. Compression springs 85 are mounted in the male connector 82, and these springs urge the female connector 81, fitted in the male connector 82, in an anti-fitting direction. Lock mechanisms 86 are provided between the female and male connectors 81 and 82.

The female connector 81 includes a box-shaped body which is formed by a top plate 87, a bottom plate 88 and side plates 89, and has open front and rear sides. The plurality of pin contacts 83 are received in the female connector 81, and when the female connector 81 is fitted into the male connector 82, the pin contacts 83 are respectively fitted into and electrically connected to the socket contacts 84 in the male connector 82.

Two slits are formed in each of the opposite side plates 89 and 89 of the female connector 81 at a central portion thereof, and an elastic retaining piece portion 90, serving as part of the lock mechanism 86, is formed between the two slits. A distal or front end of the retaining piece portion 90 is disposed slightly rearwardly of the front end of the side plate 89, and an inwardly-directed retaining claw 91 is formed at the distal end of the retaining piece portion 90.

Spring receiving portions 92 and 92 are provided respectively at opposite side portions of the male connector 82, and each spring receiving portion 92 receives the compression spring 85, and supports a rear end of this spring. A spring guide rod 93 is provided within the spring receiving portion 92, and extends in a fitting direction.

A movable cover 94 is mounted on the outer periphery of the male connector 82 for sliding movement back and forth. Spring receiving portions 95 and 95 are provided respectively at opposite side portions of this movable cover, and cover the spring receiving portions 92 and 92, respectively. The front end of each compression spring 85 urges a front end of the associated spring receiving portion 95 forwardly.

A retaining groove 96, serving as part of the lock mechanism 86, is formed in each of opposite side plates of the male connector 82. Slots 97 and 97, formed through a top plate of the movable cover 94, cooperate with projections 98 and 98, formed on a top plate of the male connector 82, to limit the forward movement of the movable cover 94 by the bias of the compression springs 85.

In the half-fitting prevention connector 80 of the above construction, when the pair of female and male connectors 81 and 82 are fitted together, the retaining claw 91 of each retaining piece portion 90 slides over a corresponding side plate 99 of the female connector 81, while elastically flexing the retaining piece portion 90 outwardly. As a result, the distal end of the retaining piece portion 90 and the retaining claw 91 abut against the front end surface of the associated spring receiving portion 95 of the movable cover 94, so that the movable cover 94 is moved rearward while compressing the compression springs 85.

When the fitting connection between the female and male connectors 81 and 82 further proceeds, the compression springs 85 are further compressed, and each retaining claw 91 is engaged in the associated retaining groove 96, so that the flexed retaining piece portion 90 is restored into an initial condition, and the front end of the retaining piece portion 90 is disengaged from the front end surface of the spring receiving portion 95 of the movable cover 94. When the pressing force for connector-fitting purposes is removed, the movable cover 94 is returned to its original position by the urging force of the compression springs 85, and the female and male connectors 81 and 82 are completely fitted together, and the pin contacts 83 are completely connected respectively to the socket contacts 84.

In this condition, the outer side surfaces of the female connector 81 are held in contact with the inner surfaces of the spring receiving portions 95, respectively, and therefore the retaining piece portions 90 will not be flexed outwardly. Therefore, each retaining claw 91 will not become disengaged from the associated retaining groove 96, and the female and male connectors 81 and 82 are completely locked together by the lock mechanisms 86.

If the pressing force is reduced or removed when the female and male connectors 81 and 82 (having the lock mechanisms 86 in which the retaining claws 91 are retainingly engageable in the retaining grooves 96, respectively) are in a half-fitted condition, the two connectors are moved away from each other by the urging force of the compression springs. Therefore, the half-fitted condition of the female and male connectors 81 and 82 can be positively detected.

In the above conventional half-fitting prevention connector 80, however, the two connectors can not be fitted together if the movable cover 94 is held by the hand during the fitting operation. Besides, if an external force is accidentally applied to the movable cover 94 after the fitting connection is effected, there is encountered a problem that the movable cover 94 is moved, so that the force to hold the two connectors in the fitted condition is reduced.

Besides, for canceling the fitted condition of the female and male connectors 81 and 82, the movable cover 94 must be pulled rearwardly away from the female connector 81 against the urging force by the compression springs 85, and in this condition each retaining piece portion 90 is flexed so as to disengage the retaining claw 91 from the retaining groove 96, which results in a problem that the operability is poor.

Furthermore, since the compression springs 85 are used, each spring receiving portion 92 must be so formed as to receive the compression spring in the normal condition, and besides the position of the spring receiving portion 92 is limited, and therefore there is encountered a problem that the housing has an increased size.

Furthermore, much time and labor is required for mounting the compression springs 85 respectively in the spring receiving portions 92, which results in a problem that the efficiency of the assembling operation can not be enhanced.

SUMMARY OF THE INVENTION

With the above problems in view, it is an object of this invention to provide a connector fitting construction in which a half-fitted condition is positively prevented when fitting a pair of male and female connectors together, and the fitted condition will not be canceled even upon accidental application of an external force after the fitting connection is effected, and the fitting operation and the disconnecting operation can be effected easily.

In order to achieve the above object, the present invention provides a connector fitting construction comprising a pair of male and female connectors to be fitted and connected together, a lock arm and a slider receiving portion being provided at one of the connectors, a resilient member and a slide lock member which is pressed by the resilient member being slidably mounted in the slider receiving portion, and an engagement projection for engagement with the lock arm being formed on the other of the connectors, wherein the slide lock member includes a first slide member having an arm portion, and a second slide member having a retaining portion, and wherein when the connectors are completely fitted together, an engagement of the retaining portion with the lock arm is canceled, so that the second slide member is moved toward a rear end of the one connector by a restoring force of the resilient member.

DETAILED DESCRIPTION OF THE PREFERRED EMBODIMENTS

Figure 1:
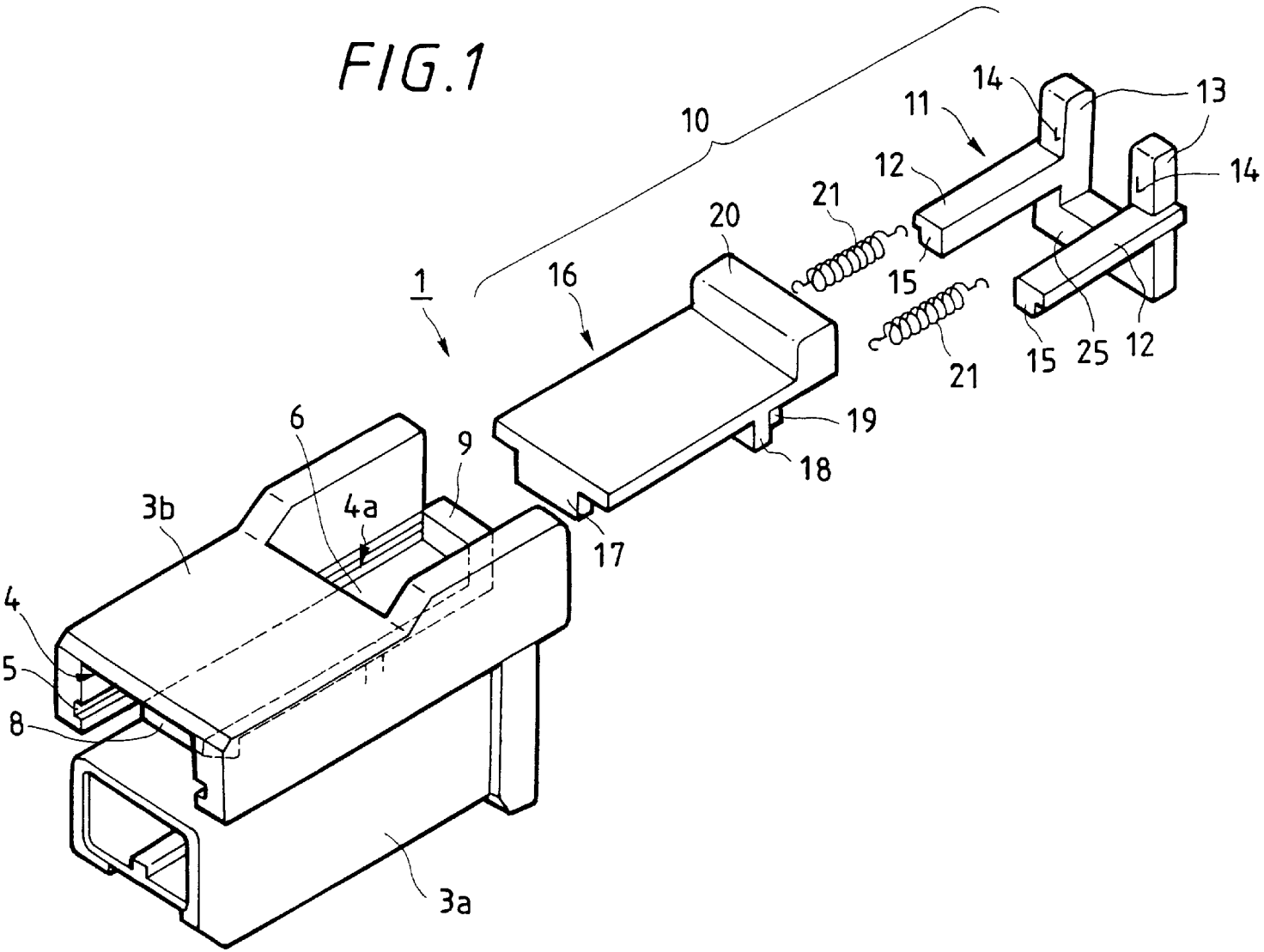
FIG. 1 is an exploded, perspective view showing a first embodiment of a connector fitting construction of the present invention.
Figure 4:
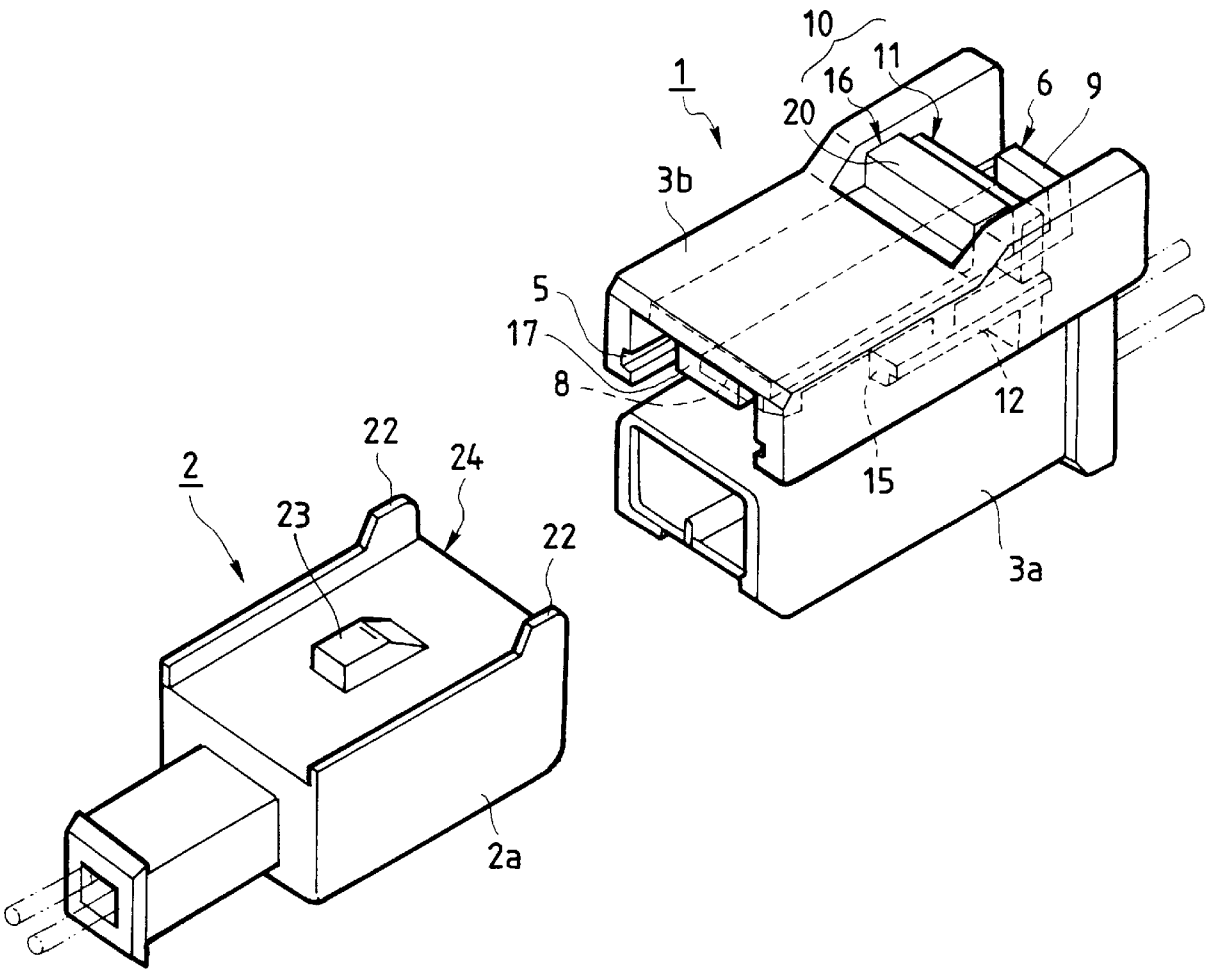
FIG. 4 is a perspective view showing a condition before the male and female connectors are fitted together.
Figure 5:
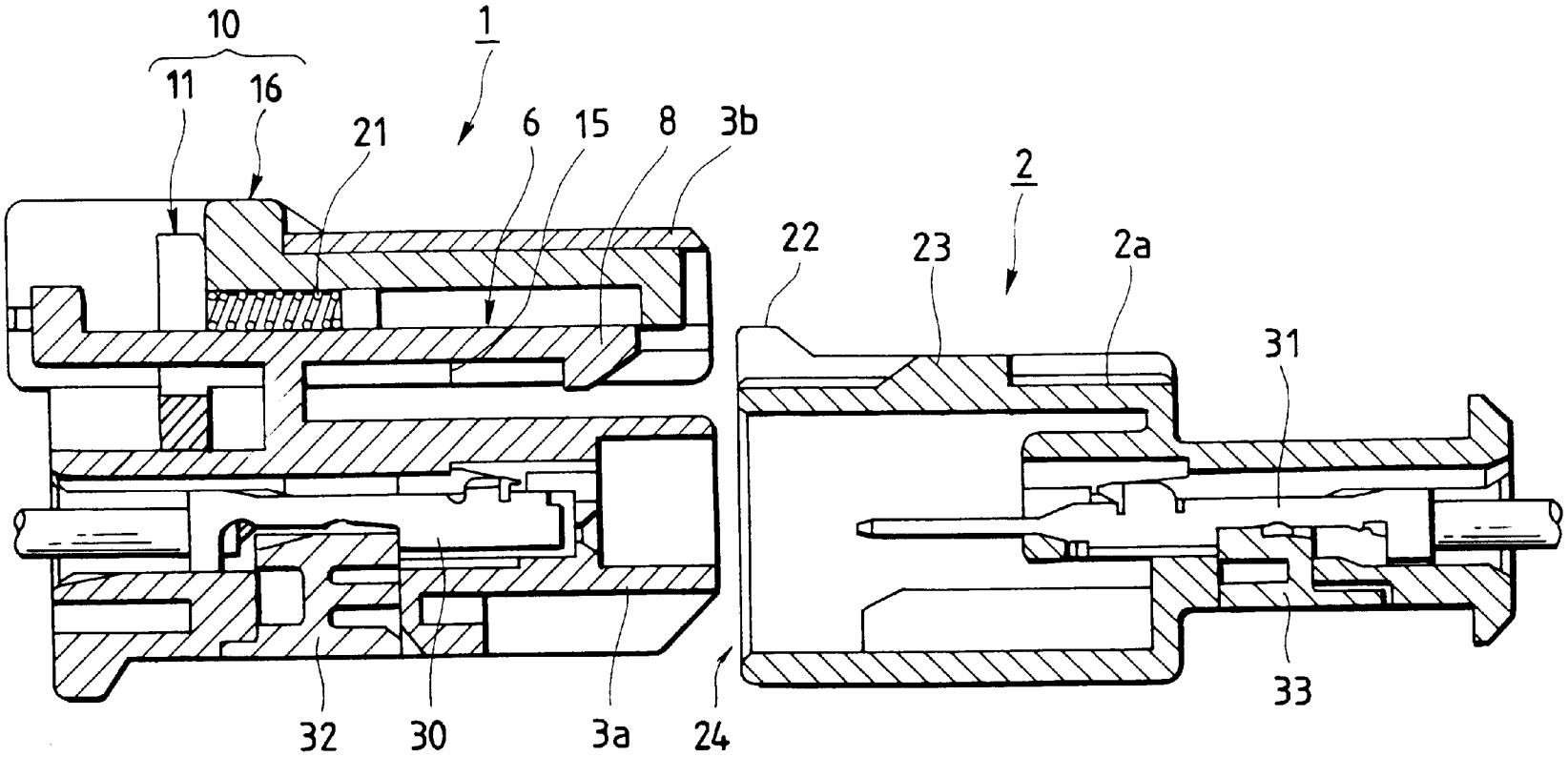
FIG. 5 is a vertical cross-sectional view of the connectors of FIG. 4.
Figure 6:
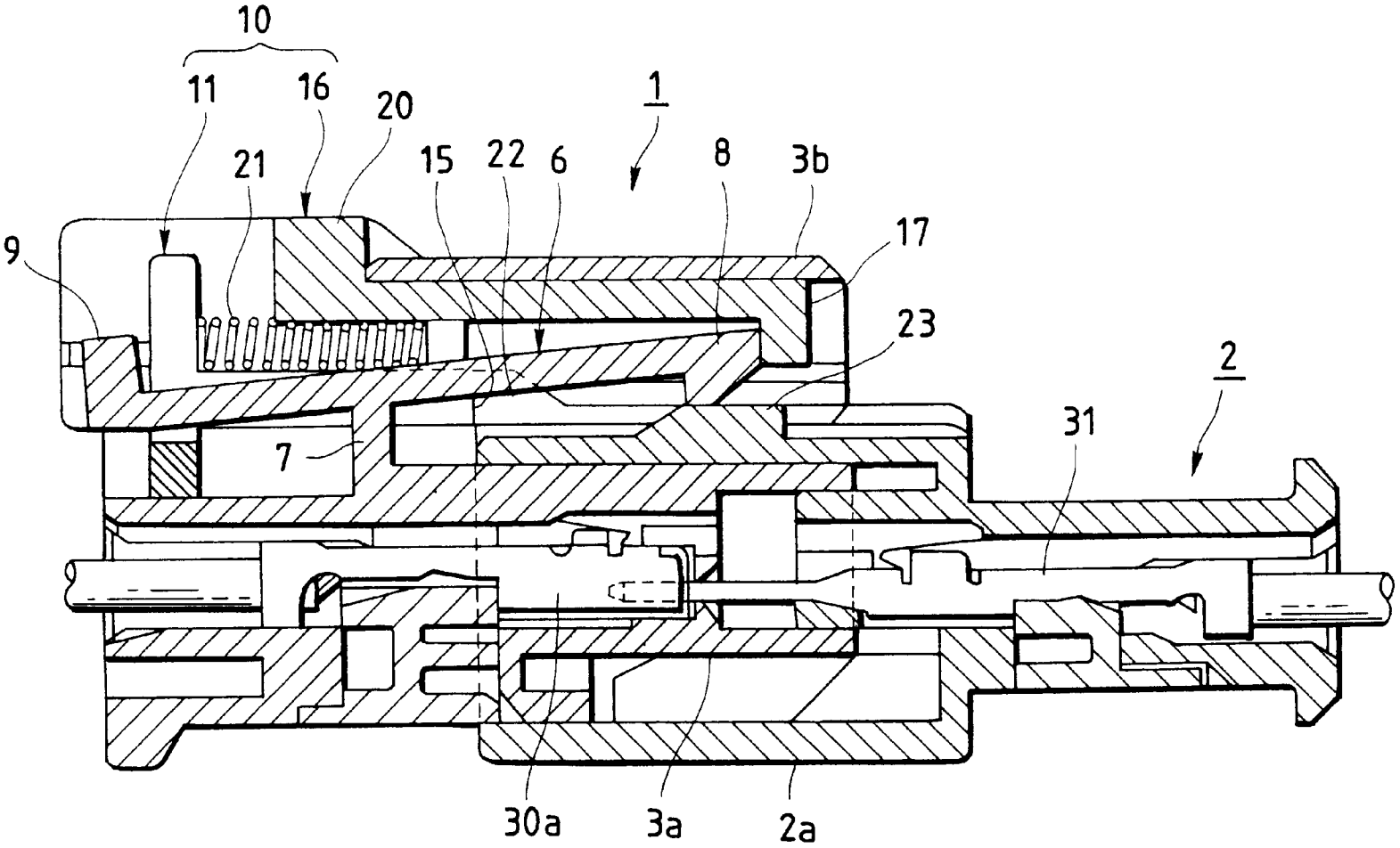
FIG. 6 is a vertical cross-sectional view showing a condition during the fitting operation.
Figure 7:
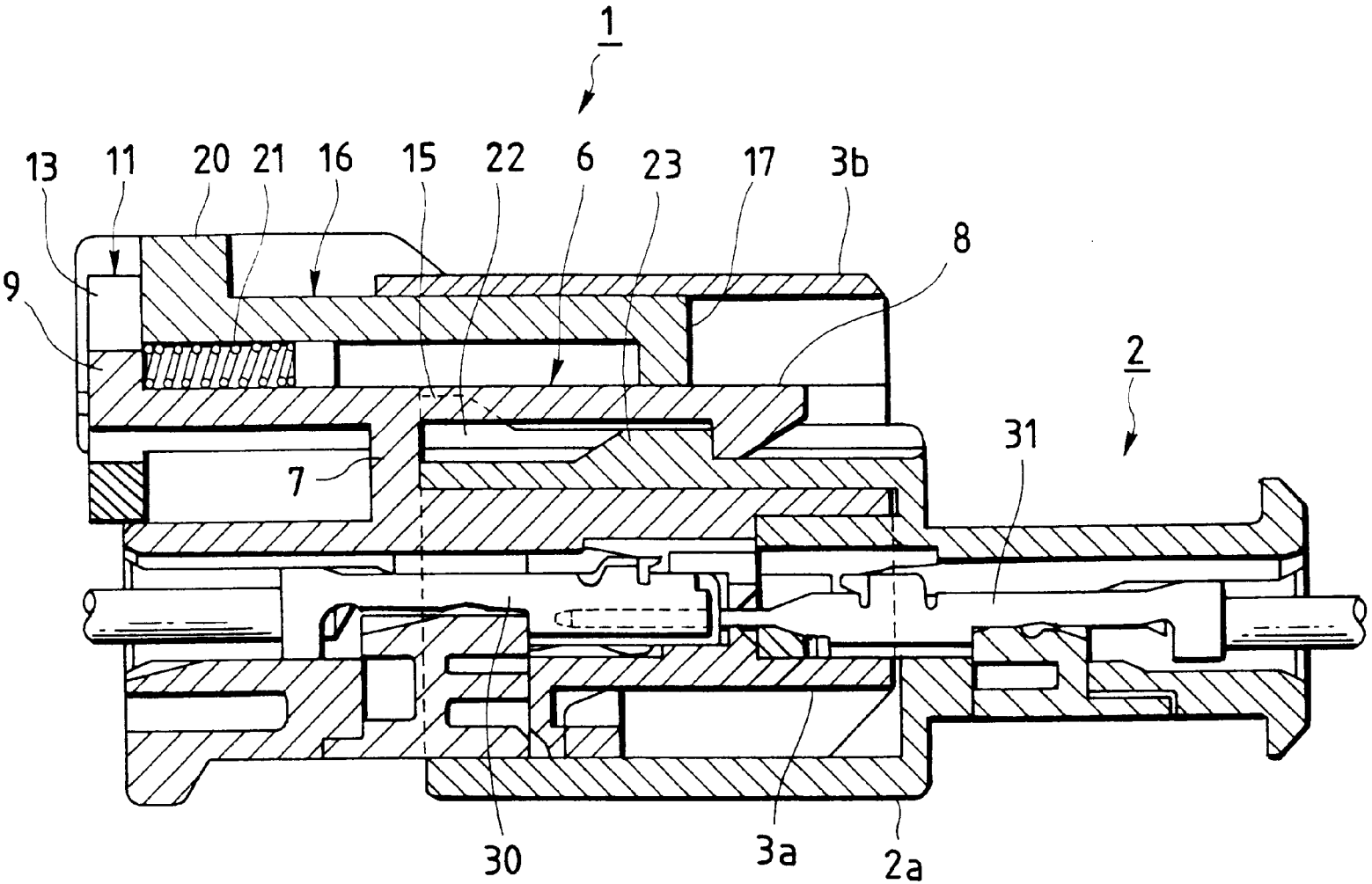
FIG. 7 is a vertical cross-sectional view showing a condition in which the fitting operation is completed.

One preferred embodiment of a connector fitting construction of the present invention will now be described in detail with reference to FIGS. 1 to 7. FIG. 1 is an exploded, perspective view of a male connector of the connector fitting construction of this embodiment, FIG. 2 is a vertical cross-sectional view of the male connector of FIG. 1, FIG. 3 is a view as seen from the front side of the male connector of FIG. 1, FIG. 4 is a perspective view showing a condition before the male and female connectors are fitted together, FIG. 5 is a vertical cross-sectional view of the connectors of FIG. 4, FIG. 6 is a vertical cross-sectional view showing a condition during the fitting operation, and FIG. 7 is a vertical cross-sectional view showing a condition in which the fitting operation is completed.

Figure 2:
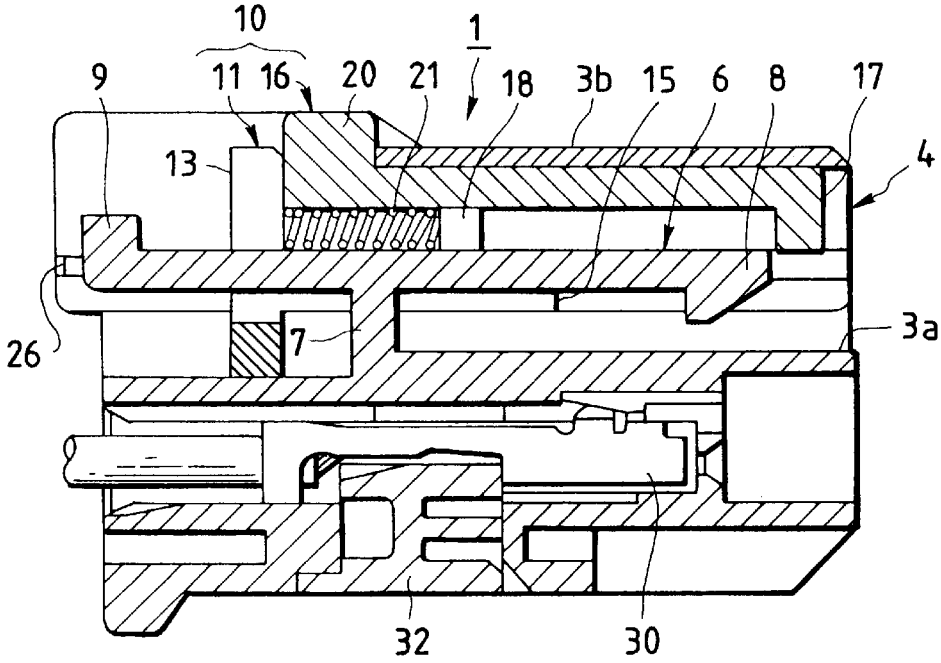
FIG. 2 is a vertical cross-sectional view of a male connector of FIG. 1.
Figure 3:
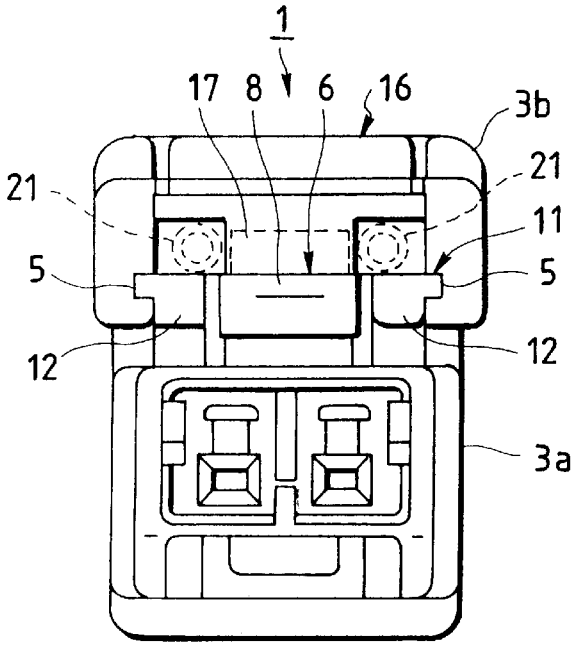
FIG. 3 is a view as seen from the front side of the male connector of FIG. 2.

As shown in FIGS. 1 to 3, the male connector 1 (one of the connectors constituting the connector fitting construction of this embodiment) comprises a housing 3*a*, which has terminal receiving chambers for respectively receiving a predetermined number of socket contacts, and is open to its front side, and a housing 3*b* in which a slider (slide lock member) 10 is slidably mounted above the housing 3*a*.

The exclusive-use housing 3*b* is provided to form a slider receiving portion 4 for receiving the slider 10. A pair of guide grooves 5 for respectively guiding opposite side portions of the slider 10 are formed respectively in inner surfaces of opposite side walls of the exclusive-use housing 3*b*. A pair of rearward-withdrawal prevention projections 26 for preventing the rearward withdrawal of a first slide member 11 (which will be described later) are formed respectively at rear ends of the guide grooves 5 (see FIG. 2).

A lock arm (seesaw-type elastic member) 6 is provided in the slider receiving portion 4 at a widthwise-central portion of a lower portion thereof, and this lock arm 6 is formed integrally with the housing 3*a* through a support portion 7, and extends along an axis in a fitting direction. A side space 4*a* for receiving the slider 10 is formed between each of opposite sides of this lock arm 6 and an inner surface of the housing. A housing lock 8 for retaining engagement with an engagement projection on a mating female housing (which will be described later) is formed on a lower surface of the lock arm 6 at a front end thereof, and a press portion 9 is formed on an upper surface of the lock arm 6 at a rear end thereof, and this press portion 9 is operated when canceling the fitted condition.

The slider 10 comprises the first slide member 11 which is guided by the guide grooves 5, and is slidable within the slider receiving portion 4, and a second slide member 16 placed on the first slide member 11.

The first slide member 11 includes a pair of arms 12 and 12, which extend in the fitting direction, and are slidably fitted at their outer side portions in the guide grooves 5, respectively, an interconnecting portion 25 interconnecting the two arms 12, and abutment posts 13. Abutment portions 15 are formed at distal ends of the arms 12, respectively, and press ribs 22 (see FIG. 4) on the female connector abut against the abutment portions 15, respectively. A pair of retaining hooks 14 and 14 are formed on front surfaces of the abutment posts 13, and one ends of tension springs (resilient members) 21 are retained by the retaining hooks 14 and 14, respectively.

The second slide member 16 includes a retaining portion 17 formed on a lower surface of a front end thereof, an operating portion 20 which is operated when canceling the fitted condition, and a pair of retainer portions 18 and 18 formed respectively on opposite side portions of the lower surface thereof. The retaining portion 17 can retain the housing lock 8 formed at the front end of the lock arm 6, and the retainer portions 18 have retainers 19, respectively, which retain the other ends of the tension springs 21, respectively.

As shown in FIG. 4, the female connector (the other connector) 2 includes terminal receiving chambers for respectively receiving a predetermined number of pin contacts, and has a housing insertion hole 24 open to a front side thereof. The pair of press ribs 22 and 22 (against which the abutment portions 15 of the first slide member 11 abut, respectively, during the connector-fitting operation) are formed on a front end portion of a housing 2*a*, and the engagement projection 23 for engagement with the lock arm 6 is formed on the housing 2*a*, and is disposed between the press ribs 22 and 22. The engagement projection 23 has a slanting surface for flexing the lock arm 6.

Next, the fitting operation for fitting the male and female connectors of the above construction together will be described.

First, the slider 10 is assembled as shown in FIGS. 1 to 4. More specifically, for assembling the slider 10, one ends of the pair of tension springs 21 are engaged respectively with the retaining hooks 14 of the first slide member 11, and the other ends of these tension springs are engaged respectively with the retainers 19 of the retainer portions 18 of the second slide member 16, so that the first slide member 11 and the second slide member 16 are integrally connected together through the tension springs 21.

Then, for mounting the slider 10 on the male connector 1, the slider 10 is pushed into the slider receiving portion 4 from the rear side of the male connector 1, and the outer side portions of the arms 12 of the first slide member 11 are fitted respectively in the guide grooves 5, and the slider 10 is moved toward the front side of the housing 3*a*, so that the slider 10 is slidably mounted on the male connector 1. In this condition, the tension springs 21 have not yet been subjected to a tension, and the slider 10 can be freely slid within the slider receiving portion 4. A temporarily-retaining mechanism (not shown) for holding the second slide member 16 in the condition, shown in FIG. 2, may be provided between one of the first and second slide members 11 and 16 and the exclusive-use housing 3*b*.

Next, as shown in FIG. 2, the socket contacts 30 each clamped to an end of an associated wire are inserted into the housing 3*a* from the rear side thereof, and are retained respectively by housing lances formed respectively in the terminal receiving chambers, and a holder 32 for double-retaining purposes is attached to the housing.

Then, as shown in FIG. 5, the pin contacts 31 each clamped to an end of an associated wire are inserted into the housing 2*a* of the female connector 2 from the rear side thereof, and are retained respectively by housing lances formed respectively in the terminal receiving chambers, and a holder 33 for double-retaining purposes is attached to the housing.

Next, the fitting operation for fitting the male and female connectors 1 and 2 (which constitute the connector fitting construction or structure of this embodiment) will be described.

As shown in FIGS. 4 and 5, the housing 3*a* of the male connector 1 and the housing insertion hole 24 in the female connector 2 are opposed to each other, and in this condition the housing 3*a* is inserted into the housing insertion hole 24, thereby starting the fitting connection between the male and female connectors.

As this fitting operation proceeds, the press ribs 22 of the female connector 2 are inserted respectively into the side spaces 4*a* (see FIG. 1), formed respectively at the opposite sides of the lock arm 6 of the male connector 1, as shown in FIG. 6, and the slanting surface of the engagement projection 23 of the female connector 2 is brought into sliding contact with the housing lock 8 at the front end of the lock arm 6, thereby displacing the front end portion of the lock arm 6 toward the second slide member 16 (upwardly in FIG. 6). Therefore, the front end portion of the lock arm 6 engages the retaining portion 17 of the second slide member 16, thereby preventing the second slide member 16 from sliding.

When the fitting operation further proceeds, the press ribs 22 abut respectively against the abutment portions 15 of the first slide member 11, and in this condition the first slide member 11 is pushed rearward. From this time on, a tension is exerted on the tension springs 21, thereby producing a restoring force tending to cause a resiliently-returning motion. At this stage, the pin contacts 31 in the female connector 2 have not yet been fully inserted respectively into the socket contacts 30 in the male connector 1, and therefore the electrical contact between each pin contact and the associated socket contact is not complete.

In this half-fitted condition in which the housing lock 8 at the front end of the lock arm 6 is not completely engaged with the engagement projection 23 of the female connector 2, if the fitting operation is stopped, the first slide member 11 is moved back by the restoring force of the tension springs 21 in a disconnecting direction opposite to the fitting direction. As a result, the female connector 2 is moved back in the disconnecting direction through the press ribs 22 abutted respectively against the abutment portions 15 of the first slide member 11, and therefore the half-fitted condition can be easily detected.

Then, when the fitting operation is further continued against the bias of the tension springs 21, the housing lock 8 at the front end of the lock arm 6 slides over the engagement projection 23 on the female connector 2, so that the lock arm 6 is elastically restored into its initial condition, as shown in FIG. 7. As a result, the engagement of the front end of the lock arm 6 with the retaining portion 17 at the front end of the second slide member 16 is canceled, and the housing lock 8 becomes engaged with the rear end of the engagement projection 23. As a result, the male connector 1 and the female connector 2 are completely fitted together, and the contacts 30 are completely electrically connected to the contacts 31, respectively.

At this time, the maximum tension, exerted on the tension springs 21, is released upon disengagement of the housing lock 8 from the retaining portion 17, and the second slide member 16 is slidingly moved back to its initial position relative to the first slide member 11 by the restoring force of the tension springs 21. In this condition, the press portion 9 at the rear end of the lock arm 6 is substantially covered with the abutment posts 13 of the first slide member 11 and the operating portion 20 at the rear end of the second slide member 16, and also the retaining portion 17 of the second slide member 16 prevents the lock arm 6 from being elastically deformed. Therefore, the application of an accidental pressing force to the press portion 9 of the lock arm 6 is positively prevented.

This completely-fitted condition can be detected through the sense of touch obtained when the housing lock 8 of the lock arm 6 slides over the engagement projection 23, and also can be easily detected by viewing the position of the returned second slide member 16.

For canceling the above completely-fitted condition, the operating portion 20 of the second slide member 16 is held by the finger or the like (see FIG. 7), and in this condition the exclusive-use housing 3*b* is moved forward, and then when the exposed press portion 9 of the lock arm 6 is pressed down by the finger or the like, the housing lock 8 of the lock arm 6 is engaged with the retaining portion 17 of the second slide member 16, as shown in FIG. 6.

In this condition, when the male and female connectors 1 and 2 are moved or drawn away from each other, the first slide member 11 is moved forward or returned by the restoring force of the tension springs 21. As a result, the female connector 2 is moved back in the disconnecting direction by the restoring force of the tension springs 21 through the press ribs 22 abutted respectively against the abutment portions 15 of the first slide member 11. Therefore, the disconnecting force, required for disconnecting the connectors from each other, can be reduced, and the efficiency of the disconnecting operation can be enhanced.

In the above connector fitting construction of this embodiment, the male and female connectors 1 and 2, when in a half-fitted condition, are moved away from each other by the restoring force of the tension springs 21, thereby preventing the half-fitted condition, and also the fitted condition can be easily detected through the sense of touch, obtained during the fitting operation, and the position of the second slide member 16.

The first slide member 11 and the second slide member 16 are connected together through the tension springs 21, and in the completely-fitted condition, any tension is not exerted on the tension springs 21, and therefore the resilient function of the springs will not be deteriorated, and even if the fitting operation is repeated for maintenance purposes and others, the accuracy of the detection will not be lowered.

For canceling the fitted condition, the retaining portion 17 of the second slide member 16 is moved forward beyond the front end of the lock arm 6, and the press portion 9 of the lock arm 6 is pressed down. As a result, the housing lock 8 of the lock arm 6 is engaged with the retaining portion 17 of the second slide member 16, and the first slide member 11 is moved forward by the restoring force of the tension springs 21, and the female connector 2 is pushed out in the disconnecting direction by this force. Therefore, the disconnecting force, required for disconnecting the connectors from each other, is reduced.

The connector fitting construction of the present invention is not limited to the above embodiment, and the invention can be applied to other embodiments. In the above embodiment, although the exclusive-use housing for receiving the slider is provided at the male connector while the press ribs and the like are provided at the female connector, there can be provided a connector fitting construction reverse in structure to the above embodiment, in which an exclusive-use housing is provided at a female connector while press ribs and the like are provided at a male connector. The slider receiving portion may be formed integrally with a hood covering the housing of the male connector.

Figure 8:
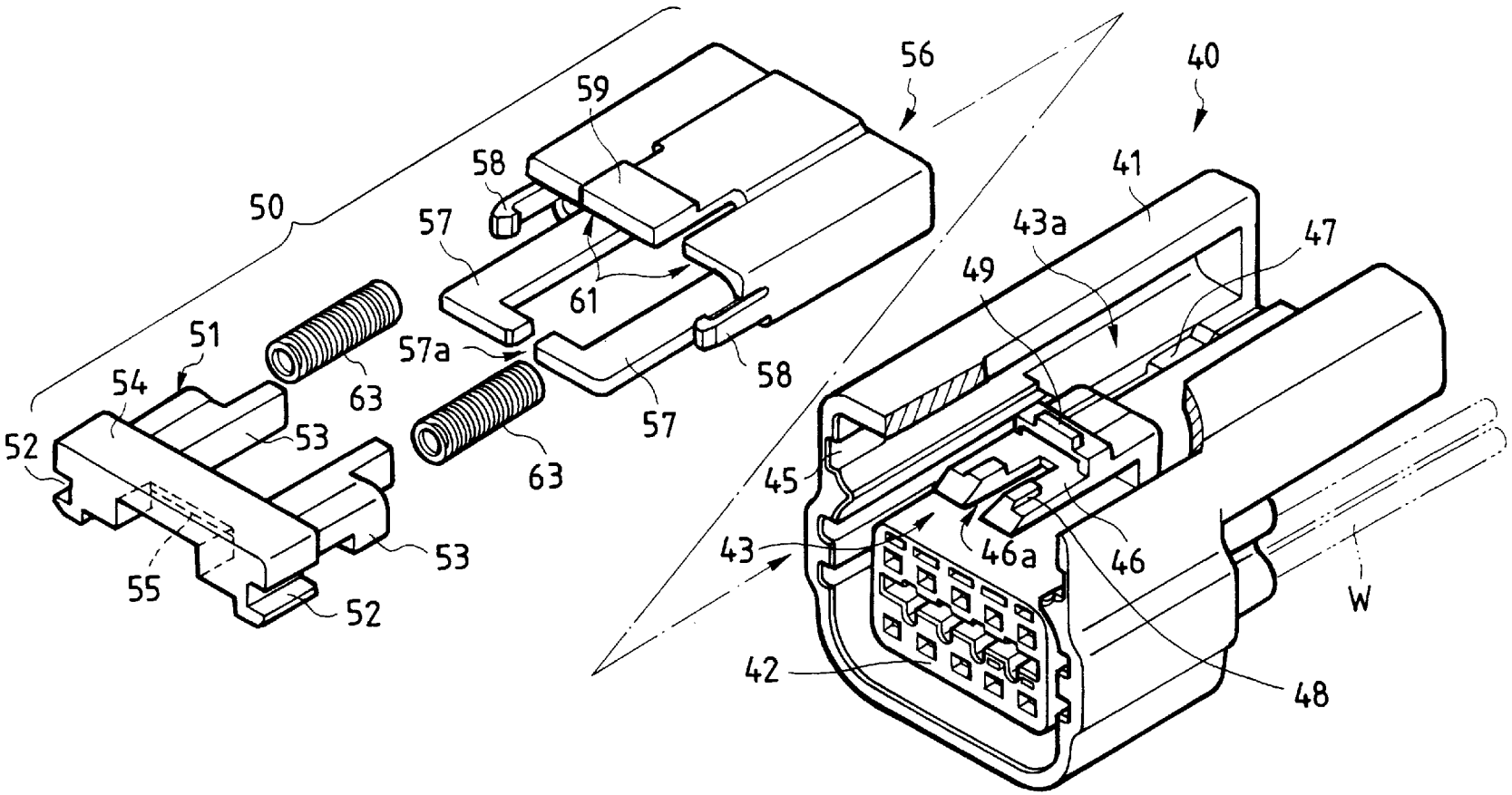
FIG. 8 is an exploded, perspective view showing a second embodiment of the connector fitting construction of the invention.
Figure 9:
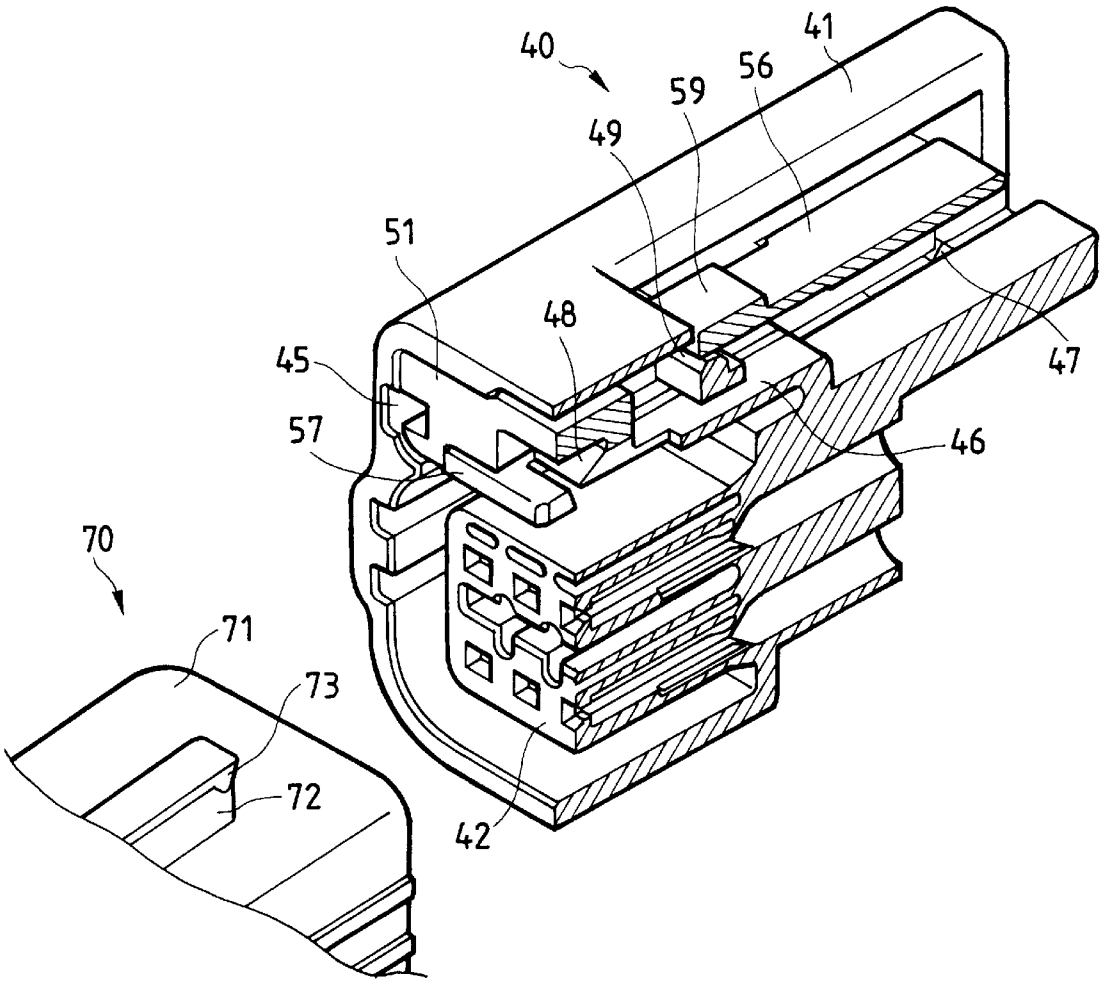
FIG. 9 is a fragmentary, perspective view showing a condition before a male connector in its assembled condition and a female connector are fitted together.
Figure 10:
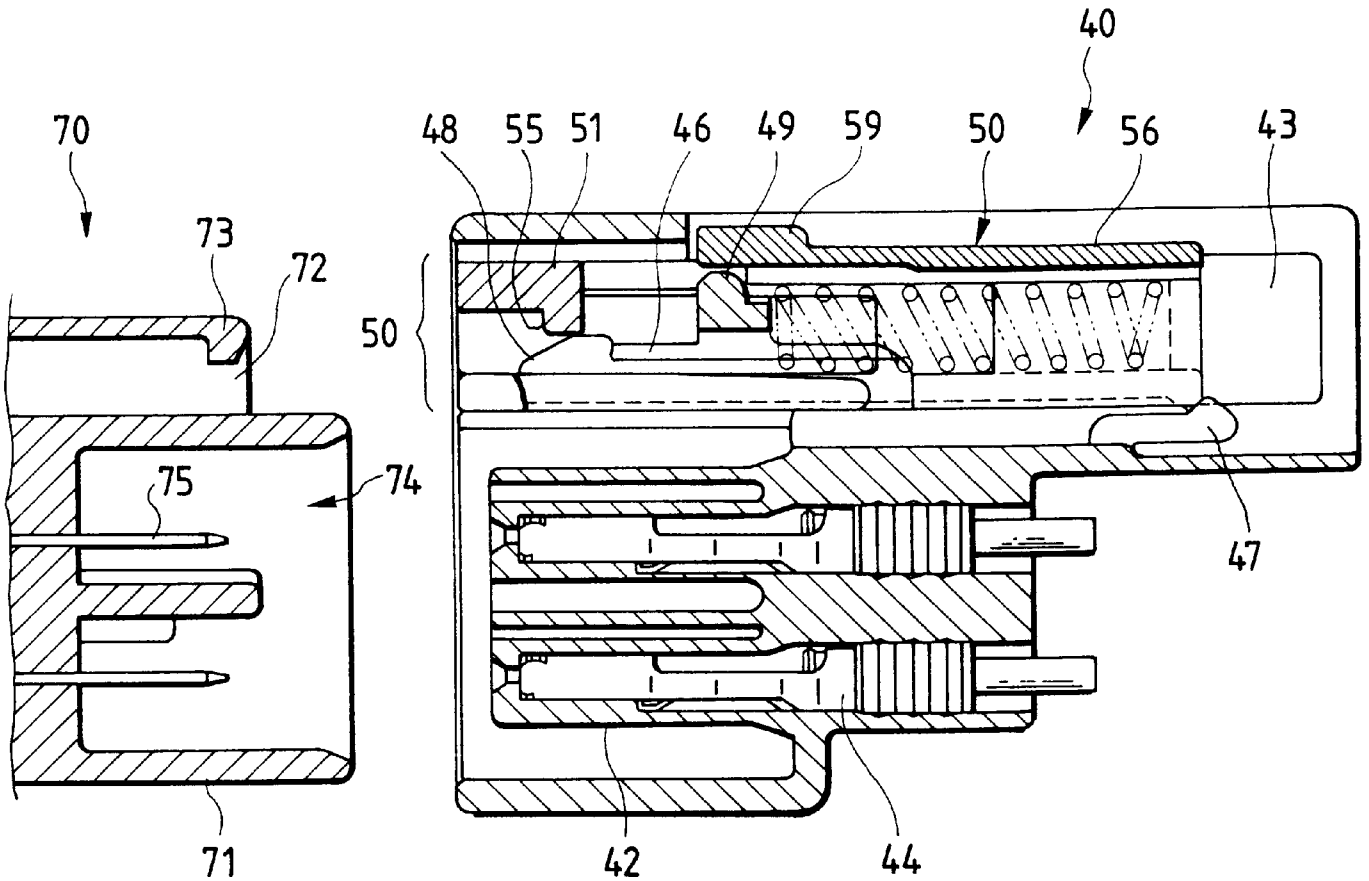
FIG. 10 is a vertical cross-sectional view of the connectors of FIG. 9.
Figure 11:
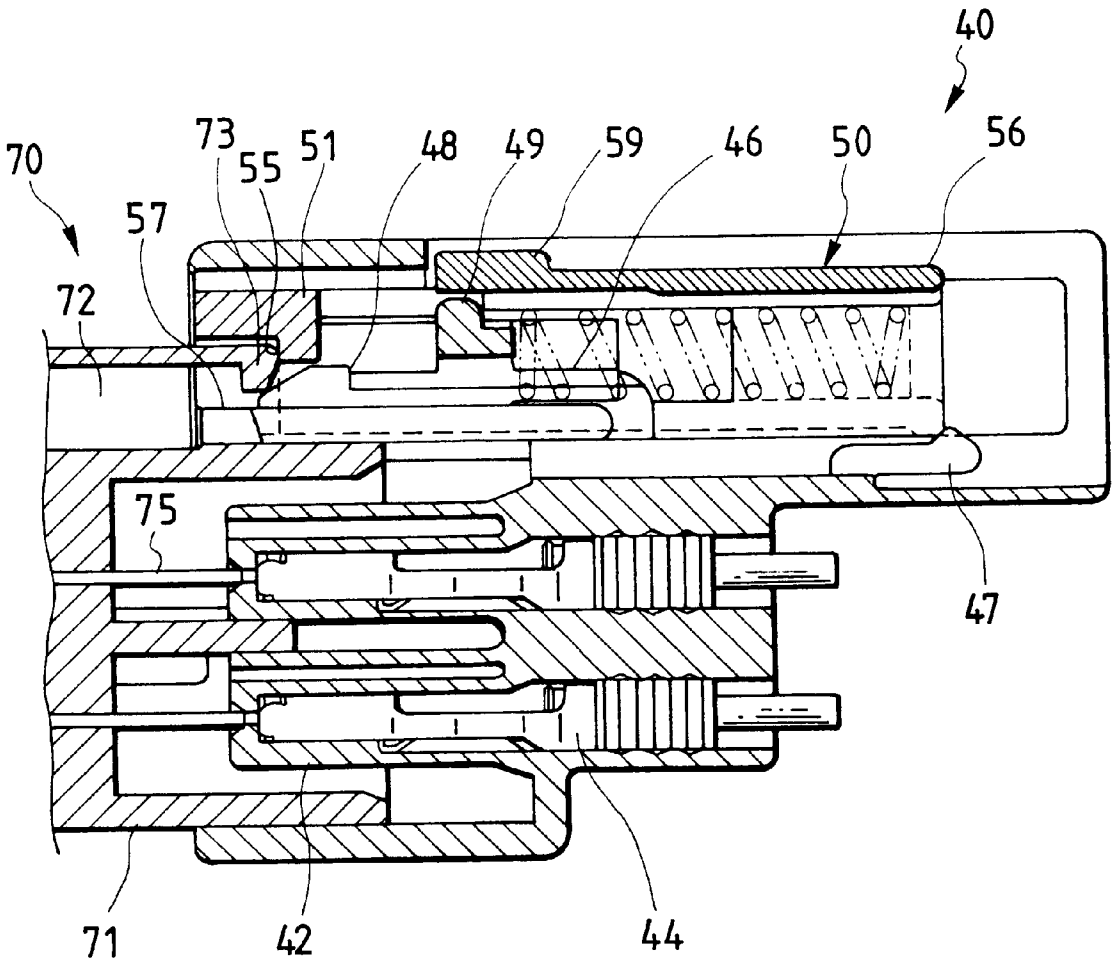
FIG. 11 is a vertical cross-sectional view similar to FIG. 10, but showing a condition in which a fitting operation is started.
Figure 12:
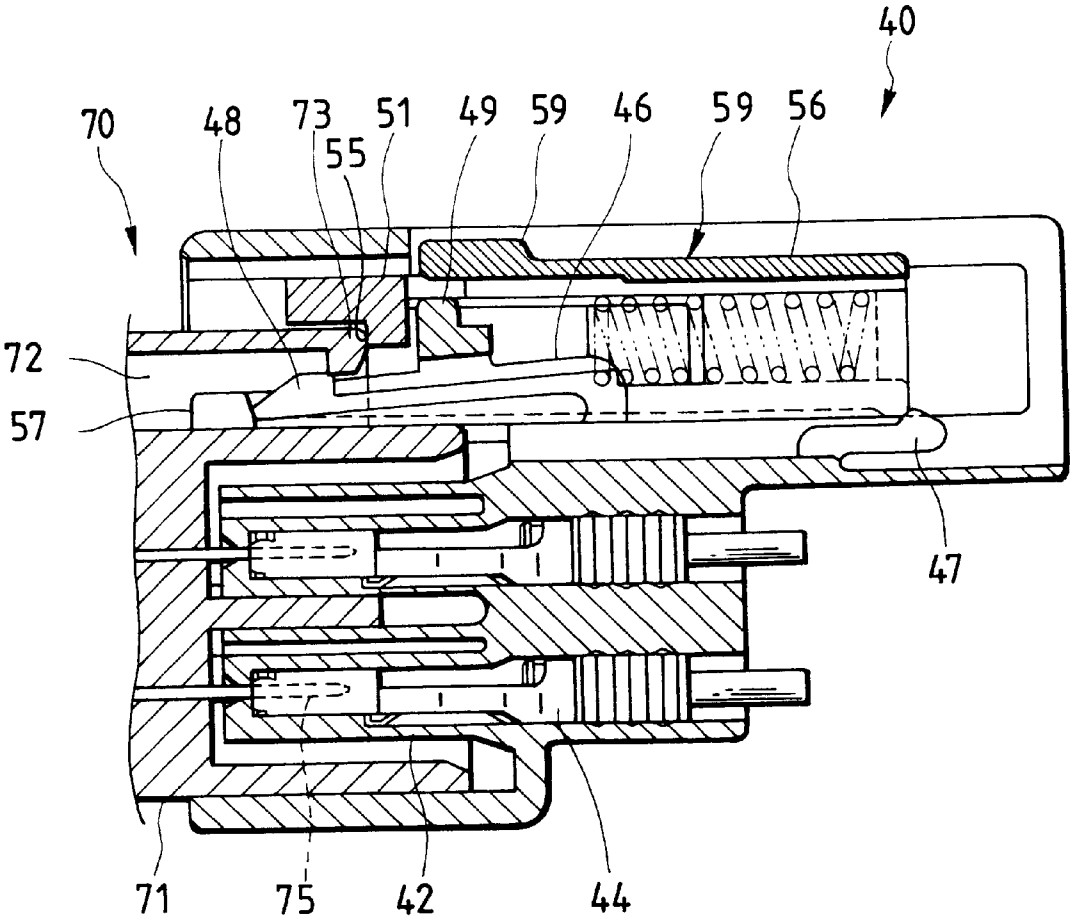
FIG. 12 is a vertical cross-sectional view showing a condition during the fitting operation.
Figure 13:
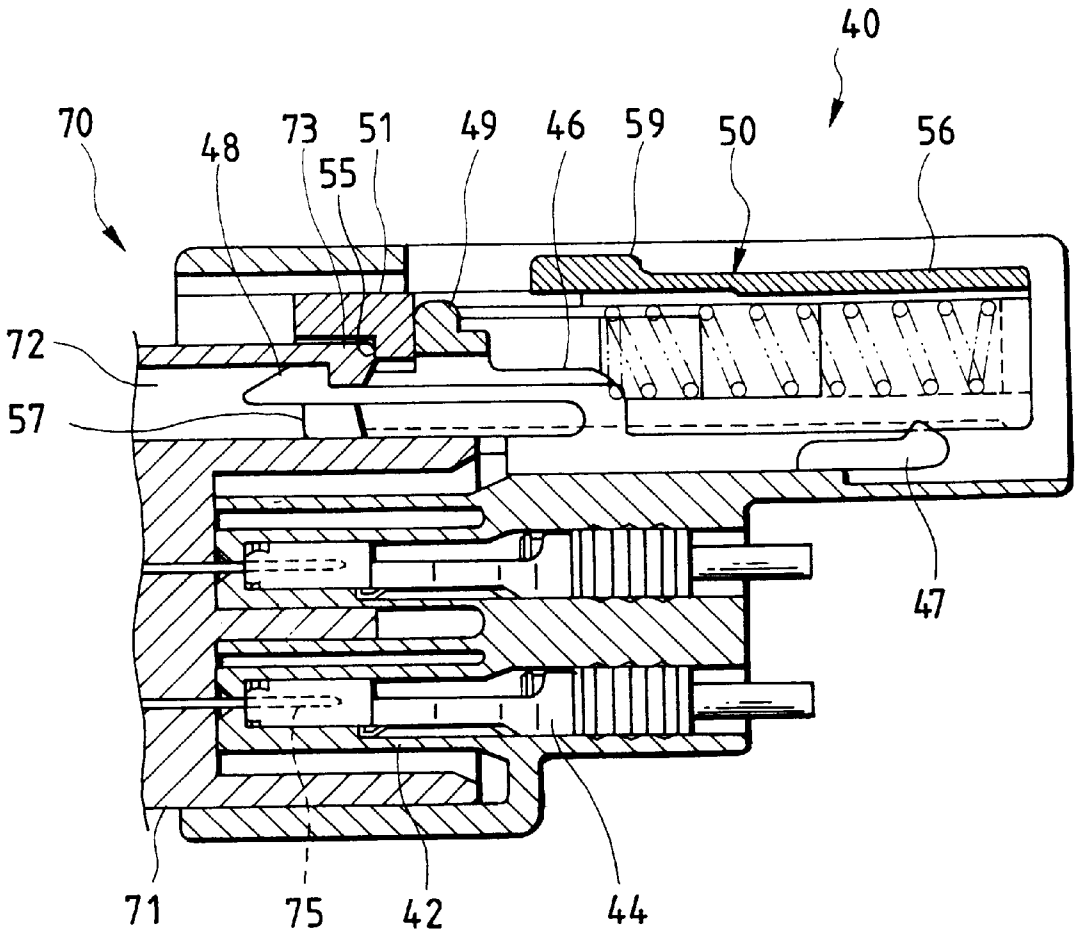
FIG. 13 is a vertical cross-sectional view showing a condition in which the fitting operation is completed.
Figure 14:
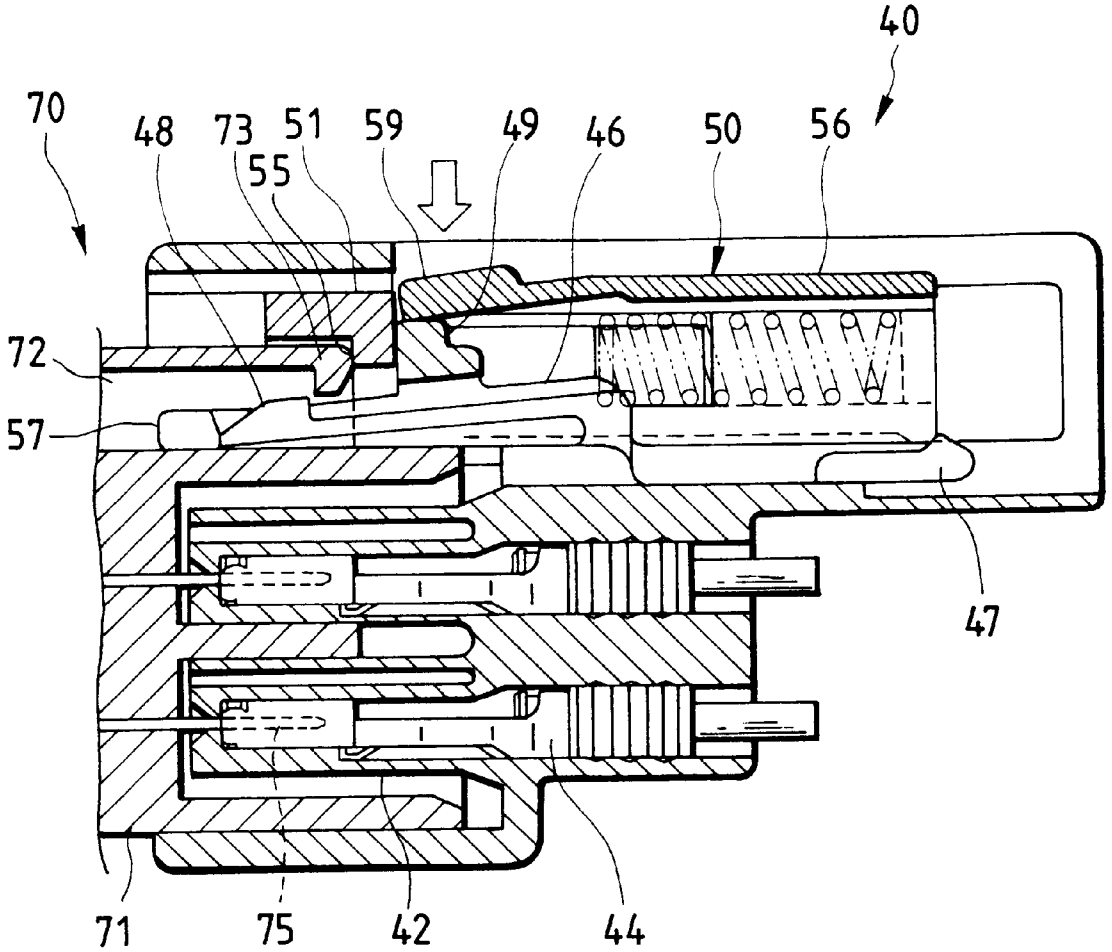
FIG. 14 is a vertical cross-sectional view showing a condition in which the fitted condition is canceled.
Figure 15:
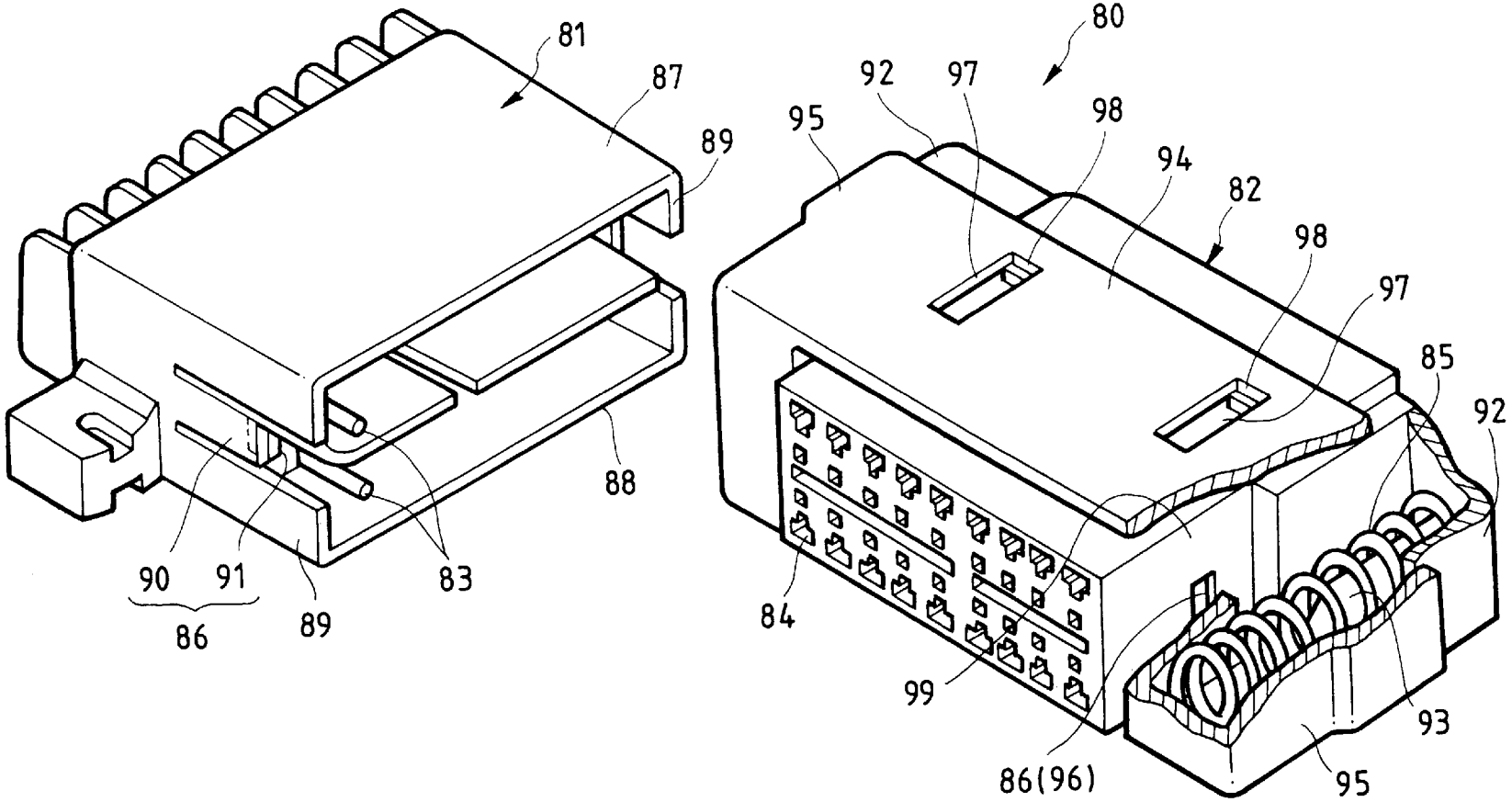
FIG.15 PRIOR ART
FIG. 15 is a perspective view showing conventional female and male connectors.

Next, a second embodiment of the connector fitting construction of the present invention will now be described in detail with reference to FIGS. 8 to 14. FIG. 8 is an exploded, perspective view of a male connector of the connector fitting construction of this embodiment, FIG. 9 is a fragmentary, perspective view showing a condition before the male connector in its assembled condition and a female connector are fitted together, FIG. 10 is a vertical cross-sectional view of the connectors of FIG. 9, FIG. 11 is a vertical cross-sectional view similar to FIG. 10, but showing a condition in which a fitting operation is started, FIG. 12 is a vertical cross-sectional view showing a condition during the fitting operation, FIG. 13 is a vertical cross-sectional view showing a condition in which the fitting operation is completed, and FIG. 14 is a vertical cross-sectional view showing a condition in which the fitted condition is canceled.

As shown in FIG. 8, the male connector 40 (one of the connectors constituting the connector fitting construction of this embodiment) comprises an inner housing 42, which has terminal receiving chambers for respectively receiving a predetermined number of socket contacts, and is open to its front side, and an outer housing 41 in which a slider (slide lock member) 50 is slidably mounted above the inner housing 42, the outer housing 41 forming a hood portion covering the outer periphery of the inner housing 42.

The outer housing 41 is provided to form a slider receiving portion 43 for receiving the slider 50. A pair of guide grooves 45 for respectively guiding opposite side portions of the slider 50 are formed respectively in inner surfaces of opposite side walls of the outer housing 41. A lock arm 46 is provided in the slider receiving portion 43 disposed above the inner housing 42, and this lock arm 46 is formed integrally with the inner housing 42, and extends along an axis in a fitting direction, and this lock arm 46 has an elastic front end portion (free end portion). A side space 43*a* for receiving the slider 50 is formed between each of opposite sides of this lock arm 46 and an inner surface of the housing.

A pair of housing locks 48 for retaining engagement respectively with engagement projections 73 (see FIG. 9) on a mating housing (which will be described later) are formed on an upper surface of the lock arm 46 at the front end thereof, and a press portion 49 is formed on the upper surface of the lock arm 46 intermediately the opposite ends thereof, and this press portion 49 is operated when canceling the fitted condition. An insertion space 46*a* for receiving a press rib 72 of the female connector 70 (which will be described later) is formed in the front end portion of the lock arm 46 including the housing locks 48.

A pair of retaining arms 47 for temporarily preventing the rearward movement of the slider 50 are provided at a rear portion of the slider receiving portion 43, and extend along the axis in the fitting direction, and a retaining projection is formed on an elastic rear end portion (free end portion) of each of the retaining arms 47.

The slider 50 comprises a first slide member 51 which is guided by the guide grooves 45, and is slidable within the slider receiving portion 43, a second slide member 56 engaged with a rear portion of the first slide member 51, and compression springs (resilient members) 63 retained in the second slide member 56.

The first slide member 51 includes a pair of rearwardly-extending stopper arms 53 and 53 which are abutted respectively against one ends of the compression springs 63, and an interconnecting portion 54 interconnecting these arms. An abutment portion 55 for abutment against the press rib 72 of the female connector 70 is formed in a lower surface of the interconnecting portion 54. A pair of slide grooves 52 and 52 for respectively slidably receiving engagement arms (which will be described later) of the second slide member 56 are formed respectively in opposite sides of the interconnecting portion 54.

The second slide member 56 is slidably fitted at their opposite side portions in the guide grooves 45, and has a retaining portion 57 which is formed on the lower side of the front end thereof, and extends forwardly, and this retaining portion 57 retains the housing locks 48 when these housing locks 48 are displaced. A passage notch 57*a* for passing the press rib 72 therethrough is formed in a central portion of a front end of the retaining portion 57. An elastic operating portion 59, which is operated when canceling the fitted condition, is formed at an upper portion of the second slide member 56 at a central portion thereof, and when the second slide member 56 is inserted into the slider receiving portion 43, this operating portion 59 covers the press portion 49 of the lock arm 46 in overlying relation thereto.

A pair of elastic engagement arms 58 and 58 are formed respectively at lower portions of the opposite side walls of the second slide member 56, and are retained respectively by the stopper arms 53 of the first slide member 51. Spring receiving chambers 61 are formed respectively in the opposite side portions of the second slide member 56, and the compression springs 63 are received and held in these spring receiving chambers 61, respectively. The compression springs 63 are inserted respectively into the spring receiving chambers 61, and the engagement arms 58 are engaged respectively with the stopper arms 53, so that the first slide member 51 and the second slide member 56 are combined together.

As shown in FIGS. 9 and 10, the female connector (the other connector) 70 has a housing insertion hole 74 open to its front side, and a predetermined number of pin contacts 75 project into the housing insertion hole 74 in a fitting direction. The press rib 72 for abutment against the abutment portion 55 of the first slide member 51 is formed upright on a central portion of an upper surface of a housing 71. The pair of engagement projections 73 are formed respectively on the opposite sides of the press rib 72, and these engagement projections 73 elastically deform the lock arm 46, and are engaged with the housing locks 48, respectively.

Next, the fitting operation for fitting the male and female connectors of the above construction will be described.

First, the slider 50 is assembled as shown in FIGS. 8 and 9. More specifically, for assembling the slider 50, the pair of compression springs 63 are inserted respectively into the spring receiving chambers 61 in the second slide member 56, and then the stopper arms 53 of the first slide member 51 are inserted respectively into the spring receiving chambers 61. Then, the engagement arms 58 are engaged respectively with the stopper arms 53, thereby combining the first and second slide members 51 and 56, with the compression springs 63 held respectively in the spring receiving chambers 61.

For mounting the slider 50 on the male connector 40, the slider 50 is inserted into the slider receiving portion 43 from the front side of the male connector 40. At this time, the stopper arms 53 of the first slide member 51, as well as the opposite side portions of the interconnecting portion 54, are fitted respectively in the guide grooves 45, and also the opposite side portions of the second slide member 56 are fitted respectively in the guide grooves 45, and the rear end of the second slide member 56 is abutted against the retaining arms 47. Thus, the mounting of the slider 50 is completed. In this condition, the slider 50 is temporarily retained by the retaining arms 47, but a compression force is not exerted on the compression springs 63. Description of the insertion of the contacts into the terminal receiving chambers in the male connector 40 is omitted.

Next, the fitting operation for fitting the male and female connectors 40 and 70 (which constitute the connector fitting construction of this embodiment) will be described.

As shown in FIGS. 10 and 11, the inner housing 42 of the male connector 40 and the housing insertion hole 74 in the female connector 70 are opposed to each other, and in this condition the outer housing 41 of the male connector 40 is fitted on the housing 71 of the female connector 70, thereby starting the fitting connection between the male and female connectors. At this time, the press rib 72 of the female connector 70 is fitted into the passage notch 57*a* in the second slide member 56, and the front end of the press rib 72 abuts against the abutment portion 55 of the first slide member 51 as shown in FIG. 11.

As this fitting operation proceeds, the press rib 72 of the female connector 70 pushes the first slide member 51, and is fitted into the insertion space 46*a* in the lock arm 46 of the male connector 40, as shown in FIG. 12. At this time, the engagement projections 73 at the front end of the press rib 72 are brought into sliding contact respectively with slanting surfaces of the housing locks 48 at the front end of the lock arm 46, and displace the front end portion of the lock arm 46 toward the housing 71 of the female connector 70 (that is, downwardly in the drawings). Therefore, the front ends of the housing locks 48 are engaged with the retaining portion 57 of the second slide member 56, and therefore the second slide member 56 can not slide in unison with the first slide member 51.

When the fitting operation further proceeds, the first slide member 51 is pushed by the press rib 72, and is moved rearward. At this time, the engagement arms 58 of the second slide member 56 are fitted respectively into the slide grooves 52 formed respectively in the opposite sides of the first slide member 51. The first slide member 51 is thus moved while the second slide member 56 is held against movement, and therefore the compression springs 63 in the second slide member 56 are compressed, thereby producing a restoring force tending to cause a resiliently-returning motion.

If the fitting operation is stopped in a half-fitted condition in which the housing locks 48 of the male connector 40 are not completely engaged respectively with the engagement projections 73 of the female connector 70, the first slide member 51 is pushed back in a disconnecting direction (opposite to the fitting direction) by the restoring force of the compression springs 63. As a result, the female connector 70 is pushed back in the disconnecting direction through the press rib 72 abutted against the abutment portion 55 of the first slide member 51, and therefore this half-fitted condition can be easily detected.

Then, when the fitting operation is further continued against the bias of the compression springs 63 as shown in FIG. 12, the engagement projections 73 of the female connector 70 slide respectively over the housing locks 48 at the front end of the lock arm 46, so that the lock arm 46 is elastically restored into its initial position. As a result, the engagement of the front end of each housing lock 48 with the retaining portion 57 at the front end of the second slide member 56 is canceled, and the housing lock 48 becomes engaged with the rear end of the associated engagement projection 73, as shown in FIG. 13. Therefore, the male and female connectors 40 and 70 are completely fitted together, and the contacts 44 are completely electrically connected to the contacts 75, respectively.

At this time, the maximum compression force, exerted on the compression springs 63, is released upon disengagement of the housing locks 48 from the retaining portion 57, and the restoring force of the compression springs 63 causes the second slide member 56 to move rearward against the retaining force applied by the elastic retaining arms 47, and therefore the second slide member 56 is returned to its initial position relative to the first slide member 51. At this time, the operating portion 59, which has covered the press portion 49 of the lock arm 46, is moved rearward, so that the press portion 49 is exposed upwardly. The retaining portion 57 of the second slide member 56 moves into a flexing space in the front end portion of the lock arm 46, and therefore the lock arm 46 is locked against elastic deformation.

Therefore, the completely-fitted condition of the male and female connectors 40 and 70 can be easily detected through the sense of touch obtained when the housing locks 48 are engaged respectively with the engagement projections 73, and also can be easily detected through the exposure of the press portion 49.

For canceling the above completely-fitted condition, the operating portion 59 of the second slide member 56 is held by the finger or the like, and in this condition the second slide member 56 is moved forward against the bias of the compression springs 63 until the exposed press portion 49 of the lock arm 46 is covered with the operating portion 59, as shown in FIG. 14. Then, when the operating portion 59 is pressed down, the press portion 49 is pressed down, and therefore the housing locks 48 of the lock arm 46 are displaced downwardly, so that the engagement of each housing lock 48 with the associated engagement projection 73 is canceled. At this time, the first slide member 51 is pushed back forwardly by the restoring force of the compressed compression springs 63.

As a result, the female connector 70 is pushed back in the disconnecting direction through the press rib 72 of the female connector 70 abutted against the abutment portion 55 of the first slide member 51. Therefore, the disconnecting force, required for disconnecting the connectors from each other, can be reduced, and the efficiency of the disconnecting operation can be enhanced.

As described above, in the connector fitting construction of this embodiment, the male and female connectors 40 and 70, when in a half-fitted condition, are moved away from each other by the restoring force of the compression springs 63, thereby preventing the half-fitted condition, and also the fitted condition can be easily detected through the sense of touch, obtained during the fitting operation, and the position of the second slide member 56.

For canceling the fitted condition, the operating portion 59 of the second slide member 56 is moved to the position where the operating portion 59 covers the press portion 49 of the lock arm 46, and then the operating portion 59 is pressed down to depress the press portion 49, thereby canceling the engagement of each housing lock 48 with the associated engagement projection 73. At this time, the first slide member 51 is pushed back forwardly by the restoring force of the compressed compression springs 63, and therefore the female connector 70 is pushed back in the disconnecting direction through the press rib 72 abutted against the abutment portion 55 of the first slide member 51. Therefore, the disconnecting force, required for the connector-disconnecting operation, can be reduced.

The connector fitting construction of the present invention is not limited to the above embodiment, and the invention can be applied to other embodiments. In the above embodiment, although the slider receiving portion is provided in the male connector while the press rib and the like are provided on the female connector, there can be provided a construction in which a slider receiving portion is provided in a female connector while a press rib and the like are provided on a male connector. Although the slider receiving portion is formed by the outer housing of the male connector, it can be formed by an exclusive-use housing as in the first embodiment.

As described above, in the connector fitting construction of the present invention, the slide lock member comprises the first slide member having the arm portions, and the second slide member having the retaining portion, and when the male and female connectors are completely fitted together, the engagement of the retaining portion with the housing lock is canceled, so that the second slide member is moved toward the rear end of one connector by the restoring force of the resilient member.

Therefore, the slide lock member is moved back forward by the restoring force of the resilient member, and also the other connector is moved back in the disconnecting direction by the restoring force of the resilient member. Therefore, the half-fitted condition during the connector-fitting operation can be easily detected, and also the disconnecting force, required for the connector-disconnecting operation, can be reduced, and the efficiency of the disconnecting operation can be enhanced.

What is claimed is:

1. A connector structure, comprising:

a pair of male and female connectors to be fitted and connected together;

a lock arm and a slider receiving portion being provided at one of said connectors, wherein said lock arm is disposed in said slider receiving portion;

a resilient member and a slide lock member which is pressed by the resilient member being slidably mounted in the slider receiving portion; and an engagement projection formed on the other of said connectors, for engagement with the lock arm, wherein the slide lock member includes a first slide member having arm portions, and a second slide member having a retaining portion for engaging with the lock arm when said engagement projection engages with said lock arm, wherein when said connectors are completely fitted together, engagement of the retaining portion with the lock arm disengages, so that the second slide member is moved toward a rear end of said one connector by a restoring force of the resilient member, and wherein said one connector has a housing lock formed at a front end of the lock arm disposed in the slider receiving portion, and side spaces are formed respectively at opposite sides of the lock arm, and wherein the arm portions of the first slide member are inserted in the side spaces, when said connectors are fitted together.

2. The connector structure according to claim 1, wherein the second slide member has an operating portion for disengaging a fitted condition between said connectors, and the operating portion substantially covers a press portion of the lock arm.

3. The connector structure according to claim 1, wherein said other connector has a press rib which abuts against the slide lock member during a fitting operation of said connectors, to facilitate the fitting operation.

4. The connector structure according to claim 3, wherein the press rib of said other connector is formed on a central portion of an outer surface of a housing of said other connector, and said engagement projection includes a pair of engagement projections which are formed respectively on opposite sides of the press rib.

5. The connector structure according to claim 1, wherein the lock arm is locked by the slide lock member when said connectors are completely fitted together.

6. The connector structure according to claim 1, wherein the first slide member includes an interconnecting portion interconnecting the arm portions, the arm portions being slidably fitted respectively in guide grooves which extend along a slide lock member insertion direction in the slider receiving portion, and which are formed respectively in opposite side portions of a housing of the connector, and wherein the first slide member has an abutment portion formed at a front end portion thereof, and the press rib of said other connector abuts against the abutment portion.

7. The connector structure according to claim 1, wherein the first slide member and the second slide member are connected together by the resilient member which comprises a tension spring, and a tension of the tension spring is released when the second slide member is moved toward the rear end of said one connector.

8. The connector structure according to claim 1, wherein the retaining portion of the second slide member has a notch for passing the press rib of said other connector therethrough during a connector-fitting operation, and an insertion space for receiving the press rib is formed in a front end portion of the lock arm.

9. The connector structure according to claim 1, wherein the first slide member and the second slide member abut respectively against opposite ends of the resilient member which comprises a compression spring, and a compression force of the compression spring is released when the second slide member is moved toward the rear end of said one connector.

10. The connector structure according to claim 9, wherein during disengagement of the completely fitted connectors, the operating portion of the second slide member is moved against a restoring force of the compression spring to a position where the operating portion covers the press portion of the lock arm, and the operating portion is pressed down, thereby disengaging the housing lock with the engagement projection.

11. The connector structure according to claim 9, wherein engagement arms are formed at a front end of the second slide member, and the first and second slide members are combined together by engaging the engagement arms respectively with the arm portions of the first slide member, and the compression spring is received in a spring receiving chamber formed in the second slide member, and slide grooves for respectively slidably receiving the engagement arms are formed respectively in opposite sides of the first slide member.

12. The connector structure according to claim 1, wherein a retaining arm for temporarily preventing a rearward movement of the slide lock member is provided at a rear portion of the slider receiving portion of said one connector.

* * * * *